US007591207B1

(12) United States Patent
Burkhardt

(10) Patent No.: US 7,591,207 B1
(45) Date of Patent: Sep. 22, 2009

(54) DEVICE AND METHOD FOR REMOTELY MANIPULATING A MAGNETIC OBJECT WITH AT LEAST A PORTION THEREOF HAVING A SUBSTANTIALLY PRISMATIC SHAPE

(76) Inventor: George Wayne Burkhardt, 11235 New Sulphur Springs Rd., San Antonio, TX (US) 78263

( * ) Notice: Subject to any disclaimer, the term of this patent is extended or adjusted under 35 U.S.C. 154(b) by 0 days.

(21) Appl. No.: 11/974,039

(22) Filed: Oct. 11, 2007

Related U.S. Application Data

(60) Provisional application No. 60/851,862, filed on Oct. 13, 2006.

(51) Int. Cl.
*B25B 13/02* (2006.01)
*B25B 23/12* (2006.01)

(52) U.S. Cl. ..... 81/125; 81/64

(58) Field of Classification Search ..... 81/125, 81/13, 64, 177.2, 177.6, 438, 176.15, 119
See application file for complete search history.

(56) References Cited

U.S. PATENT DOCUMENTS 2,701,491 A * 2/1955 Ross ..... 81/64
2,758,494 A * 8/1956 Jenkins ..... 81/438
4,145,939 A 3/1979 Garrison
4,794,827 A 1/1989 Poling
4,862,776 A 9/1989 Poling
5,074,173 A * 12/1991 Cearley ..... 81/177.6
5,199,331 A 4/1993 Tsukamoto
5,279,188 A * 1/1994 Seeger et al. ..... 81/64
5,499,557 A 3/1996 Fry
5,544,555 A 8/1996 Corley
5,572,913 A 11/1996 Nasiell
5,642,647 A 7/1997 Peruski
5,916,340 A 6/1999 Forsyth
6,006,630 A 12/1999 Vasichek
6,260,451 B1 7/2001 Mirabito
6,810,774 B2 11/2004 Hsien
6,955,105 B2 10/2005 Chen
7,044,031 B1 * 5/2006 Mullen ..... 81/125
7,328,636 B2 * 2/2008 Camacho ..... 81/439

* cited by examiner

*Primary Examiner*—Hadi Shakeri

(57) ABSTRACT

A device and method for remote manipulation of a magnetic object with at least a portion thereof having a substantially prismatic shape. The device includes a head having a magnetic field wherein the head includes a face contact surface and a magnetic extension piece. The face contact surface and the magnetic extension piece are configured to contact and thereby, concentrate and shape the magnetic field into an end surface and no more than two side surfaces of the prismatic shape, respectively, whereby when the prismatic shape is placed in proximity to the head, the magnetic field draws the end surface of the prismatic shape into contact with the face contact surface and the no more than two side surfaces of the prismatic shape into contact with the magnetic extension piece. The device thereby engaging the magnetic object and allowing for its remote manipulation.

21 Claims, 12 Drawing Sheets

DEVICE AND METHOD FOR REMOTELY MANIPULATING A MAGNETIC OBJECT WITH AT LEAST A PORTION THEREOF HAVING A SUBSTANTIALLY PRISMATIC SHAPE

CROSS-REFERENCE TO RELATED APPLICATIONS

This application claims the benefit of Provisional Patent Application Ser. No. 60/851,862, filed Oct. 13, 2006 by the present inventor.

FEDERALLY SPONSORED RESEARCH

None.

SEQUENCE LISTING

None.

BACKGROUND OF THE INVENTION

1. Field of Invention

This invention relates to remotely manipulating a magnetic object with at least a portion thereof having a substantially prismatic shape, and more specifically to a device and method for remote placement, installation, and/or removal of a magnetic object such as fastener, bolt, nut, plug, screw, and the like: in limited access locations.

2. Prior Art

The ever increasing design constraints placed on the development of modern machinery has resulted in removable objects typically used for securing of parts or passageway closures to be disposed in limited access areas and require removal/installation from a more desirable remote location. These generally magnetic objects are usually threaded and have at least a portion thereof exhibiting a substantially prismatic shape. As used herein, a "prismatic shape" is a solid whose ends are polygonal and equal in size and shape and whose sides are parallelograms. Typically, the prismatic ends of these objects are hexagonal or square. Tools, such as various wrenches, ratchets comprising various sockets and extension bars, etc., exist for initial installation (starting or insertion of an object onto/into a counterpart and if it is threaded, screwing onto/into a threaded counterpart), final removal (removal of a pre-loosened object from its counterpart and if it is threaded, unscrewing from its threaded counterpart), and/or placement of these objects in usually remote limited access areas. However, these tools are typically either expensive; fit only one size object; not articulated; do not properly engage objects with their counterparts in adverse orientations; and are bulky, therefore, they are not conducive to placement, initial installation, and/or final removal of the objects. In addition, the installation of most threaded fasteners, including bolts and nuts, usually require that a washer, spacer, or the like be installed, however conventional wrenches and tools do not have the capability to adequately hold and maintain alignment of both a fastener and washer for remote installation at unfavorable orientations in limited access locations. With respect to removing oil drain plugs in engines, transmissions, etc., the plug is typically loosened with a conventional wrench and is then further unscrewed and removed by hand. This results in the probability of hot oil getting on hands, arms, and/or floor and the probability that the plug will be dropped in the oil drain container. This drain plug removal process, which is the norm, poses additional safety hazards when draining hot oil from a hot engine because the hot oil can burn the skin and inadvertently dropping the plug in the oil container can splash hot oil into the eyes or face. In addition, the drain plug removal process is further compounded on cars and other vehicles that are low to the ground which results in drain plugs that are not easily accessible. The requirement for drain plug final removal is a device that easily engages with the plug and places the hand and arm at a remote distance from the plug, thus, preventing hot oil from contacting the body and a device that facilitates removal of the plug in areas of limited access.

To facilitate the manipulation of magnetic objects either remotely and/or in areas of limited access, numerous prior art tools have been developed but they all heretofore known suffer from a number of deficiencies and drawbacks. In general, these tools fit into 2 categories, namely (1) those that position, install, and remove fasteners, bolts, nuts, screws and the like and (2) those that position, install, and remove plugs, such as oil drain plugs. Category 1 is further sub-divided into wrenches with fixed jaws, socket wrenches, and other miscellaneous tools.

Examples of prior art wrenches with fixed jaws are U.S. Pat. No. 6,955,105 issued Oct. 18, 2005 to Chuan-Chen Chen and U.S. Pat. No. 6,810,774 issued Nov. 2, 2004 to Chih-Ching Hsien. These wrenches have a permanent magnet integrated in a jaw or adjacent to a jaw for holding the magnetic object within the jaws of the wrench. The disadvantages of this type of wrench are that it cannot fit into areas of limited access; cannot articulate because the handle is rigid; fits only one size of fastener on each end of the wrench; cannot secure and maintain alignment of both a nut and washer or washer to the head of a bolt; is relatively expensive because a set of wrenches are usually required; and is not conducive to initial installation of a magnetic object.

Examples of prior art socket wrenches are U.S. Pat. No. 6,006,630 issued Dec. 28, 1999 to Richard A. Vasichek, Robert J. Vasichek, Gregory J. Grote, and Paul D. Sigaty; U.S. Pat. No. 5,916,340 issued Jun. 29, 1999 to Don Forsyth; and U.S. Pat. No. 5,544,555 issued Aug. 13, 1996 to Ronald E. Corley. These wrenches have a permanent magnet(s) integrated within the cavity of the socket for holding a magnetic fastener. The disadvantages of this type of wrench are that it fits only one size of object per socket; relatively expensive because a set of sockets are usually required; cannot secure and maintain alignment of both a nut and washer or washer to the head of a bolt; articulation is possible with the use of universal joints and extensions but is limited, thereby reducing the usefulness in restricted areas; and is not conducive to initial installation of a magnetic object.

Another example of a prior art socket wrench is U.S. Pat. No. 5,572,913 issued Nov. 12, 1996 to Gustav Nasiell. This wrench comprises a socket body having spring biased jaws and a flexible arm with an internal flexible shaft. The flexible arm can be configured to bias the flexible shaft into the required curve appropriate for performing placement, initial installation, and/or final removal of fasteners, spark plugs, and the like in limited access areas with the jaws being able to grasp varying sizes of heads. The disadvantages of this type wrench or tool are that it has a number of moving parts and therefore, it is relatively expensive; the jaws have a limited head grasping range and therefore, cannot adapt to a wide range of fasteners and the like; as the jaws expand to accommodate larger fastener heads, the jaw faces become non-parallel to the fastener head sides and therefore, have the tendency to not grasp the fastener head securely; the flexible arm cannot be removed from the tool and used only with the flexible shaft; it has deficiencies with respect to oil drain plug removal in that the many moving parts and cavities would entrap oil and be hard to clean and since the flexible arm is relative rigid, the drain plug will not automatically fall out of the oil stream via the force of gravity, resulting in splashing of the oil.

An example of prior art of a miscellaneous tool is U.S. Pat. No. 5,642,647 issued Jul. 1, 1997 to Robert Peruski. This tool comprises a coiled wire loop, a corresponding loop shaped backing plate, and a handle. The wire loop and loop shaped backing plate form a pocket for receiving and holding the head of an object. The disadvantages of this tool are that it cannot secure and maintain alignment of both a nut and washer or washer to the head of a bolt; cannot articulate because the handle is rigid; is relatively bulky and therefore, cannot be used in limited access areas; and is not conducive to initial installation and final removal of a magnetic object.

Examples of tools applicable to category 2, above, are U.S. Pat. No. 4,794,827 issued Jan. 3, 1989 to Denzil Poling, U.S. Pat. No. 4,145,939 issued Mar. 27, 1979 to Ward S. Garrison, and U.S. Pat. No. 5,199,331 issued Apr. 6, 1993 to Kazuichi Tsukamoto. In general, these tools comprise a rotatable socket with adjustable jaws to accommodate and secure various drain plug head sizes and a handle for rotation of the socket and plug. In addition, these tools generally have a permanent magnet attached to the inside of the socket to retain the drain plug. U.S. Pat. Nos. 4,794,827 and 4,145,939 further comprises a line for tethering the socket to an anchor to prevent the socket with attached drain plug from falling a distance greater than the line length. U.S. Pat. No. 5,199,331 further comprises a concave shield to catch and deflect draining oil away from the hand of the user. The main disadvantage of these tools is that they do not provide for remote rotation and removal of the drain plug to ensure that hot oil does not contact the user's hand and/or arm. While U.S. Pat. No. 5,199,331 comprises a concave shield to catch the initial oil, it cannot be ensured that oil will not contact the user because (1) if the user does not move the tool out of the oil stream quickly, the concave shield can overflow onto the user and (2) if the tool is removed quickly, oil can splash out of the concave shield and onto the user. In addition, the tethered tools utilize a permanent magnet to attach the tether to a convenient anchor, usually the oil pan, which in many cases is not made from magnetic material. Furthermore, the tools have a single purpose use and cannot be readily used for other applications.

Another example of a tool applicable to category 2, above is U.S. Pat. No. 5,499,557 issued Mar. 19, 1996 to James K. Fry. This tool comprises a removable socket at the head of the tool, a rotatable handle disposed opposite from the head, and mechanical linkage connecting the socket with the handle, whereby, rotation of the handle is translated to rotation of the socket. While the tool provides for remote rotation and removal of the drain plug, it has other disadvantages, namely: (1) the tool is mechanically involved, hence, expensive, (2) it requires a set of special sockets to accommodate varying size drain plugs, further increasing the cost, (3) the tool is hard to clean due to many crevices to entrap oil that runs over the tool, and (4) the tool has a single purpose use and cannot be readily used for other applications.

Additional examples of tools applicable to category 2, above are U.S. Pat. No. 4,862,776 issued Sep. 5, 1989 to Denzil Poling and U.S. Pat. No. 6,260,451 issued Jul. 17, 2001 to Frank D. Mirabito. U.S. Pat. No. 4,862,776 comprises a clip for rotatably engaging and holding a drain plug head, a flexible shaft connected to the clip, and a handle connected to the other end of the shaft for manually rotating the shaft and clip for the purpose of unscrewing an attached drain plug. The clip comprises openable spring biased jaws to secure the drain plug head. While the tool provides for remote rotation and removal of the drain plug, it has other disadvantages, namely: (1) the drain plug has to be unscrewed far enough to permit the jaws to contact the back side face of the drain plug head which could result in leakage of oil, (2) if the shaft is flexed during plug removal, as would be the usual case, the jaws tend to rotate off the drain plug center axis causing undue flexing of the shaft and unstable rotation of the tool, (3) oil will be hard to clean off of the clip because of its involved geometry, and (4) the tool has a single purpose use and cannot be readily used for other applications. U.S. Pat. No. 6,260,451 comprises a tool head, a flexible shaft connected to the tool head, and a handle connected to the other end of the shaft for manually rotating the shaft and tool head for initial installation and final removal of threaded drain plugs. The tool head comprises cavities for engaging with drain plug heads incorporating protrusions. The disadvantage of this tool is that it works only on drain plugs that have heads with protrusions, hence, it has a very limited application base.

While these tools usually provide for manipulating objects with at least a portion thereof having a substantially prismatic shape, such as fasteners, bolts, nuts, plugs, screws, and the like, they all heretofore known suffer from deficiencies and drawbacks. There remains a need in the art for an inexpensive, universal, easy to clean, and simple-to-use device that permits remote placement, initial installation, and/or final removal of these objects (1) in distant areas of limited access, (2) by self adapting to a wide range of object heads, (3) simultaneously with washers, spacers, and the like while maintaining preplaced alignment with the object, (4) in off axis locations were device articulation is required, (5) with a tool having no moving parts, (6) in particular, drain plugs, without hot oil or other liquid being drained contacting hands and/or arms, and (7) while maintaining adequate engagement with the objects when at adverse orientations.

SUMMARY

In accordance with the present invention, a novel, simple, inexpensive, and universal device and method for remotely manipulating a magnetic object with at least a portion thereof having a substantially prismatic shape such as a fastener, bolt, nut, plug, screw, and the like in limited access locations is disclosed. The device generally comprises a head, a flexible shaft, and a handle. The head has a magnetic field, an upper side, a lower side, and at least one magnetic pole extension piece having two magnetic pole extension piece halves. The upper side of the head and the two magnetic pole extension piece halves are so arranged to concentrate and shape the magnetic field. The flexible shaft is connected to the lower side of the head at one end and the handle is connected to the flexible shaft at its other end. When the prismatic shape of the magnetic object is placed in proximity to the upper side of the head, the magnetic field draws an end of the prismatic shape into contact with the upper side of the head and two sides of the prismatic shape into contact with the two magnetic pole extension piece halves, thereby, engaging the magnetic object with the device and allowing for its remote manipulation. The magnetic pole extension piece halves have a spaced relationship with respect to each other such that they can be set to contact any two sides of any prismatic shape, either square, hex, or otherwise. In alternate embodiments, an adjustable modular arm assembly is associated with the flexible shaft to maintain the flexible shaft in a user defined configuration for remote manipulation of the magnetic object in distant areas of limited access. An additional alternate embodiment includes a method of remotely manipulating the magnetic object using the device.

Accordingly, the present invention may have one or more of the following advantages which are:

(a) to provide a device that will permit remote placement, initial installation, and/or final removal of magnetic objects with at least a portion thereof having a substantially prismatic shape such as fasteners, bolts, nuts, plugs, screws, and the like in limited access locations;

(b) to provide a device that will engage with all sizes of magnetic objects with a given prismatic shape;

(c) to provide a device that will permit remote placement, initial installation, and/or final removal of both magnetic objects (with at least a portion thereof having a substantially prismatic shape) and washers, spacers, or the like simultaneously;

(d) to provide a device that will permit remote placement, initial installation, and/or final removal of magnetic objects, with at least a portion thereof having a substantially prismatic shape, in off axis locations were extreme device articulation is required;

(e) to provide a device without moving parts;

(f) to provide a device that will permit remote placement, initial installation, and/or final removal of magnetic objects, with at least a portion thereof having a substantially prismatic shape, in adverse locations were pre-adjusted flexible shaft articulation is required to remain fixed;

(g) to provide a device that will permit the remote removal of drain plugs while limiting the possibility of hot oil or other liquid being drained from contacting hands and/or arms;

(h) to provide a method for remote placement, initial installation, and/or final removal of magnetic objects with at least a portion thereof having a substantially prismatic shape such as fasteners, bolts, nuts, plugs, screws, and the like in distant locations of limited access; and (i) to provide a device that is inexpensive, universal, easy to clean, and simple to use. Still further advantages may become apparent from a consideration of the ensuing description and the drawings.

DRAWINGS

A better understanding of the present invention may be had by reference to the drawing figures wherein.

DETAILED DESCRIPTION OF THE EMBODIMENTS

The present invention relates to remotely manipulating a magnetic object with at least a portion thereof having a substantially prismatic shape, and more specifically to a device and method for remote placement, initial installation, and/or final removal of magnetic objects such as fasteners, bolts, nuts, plugs, screws, and the like in limited access locations.

Preferred Embodiment

FIG. 1, FIG. 1A, FIG. 2A, FIG. 2B, and FIG. 3

Figure 1:
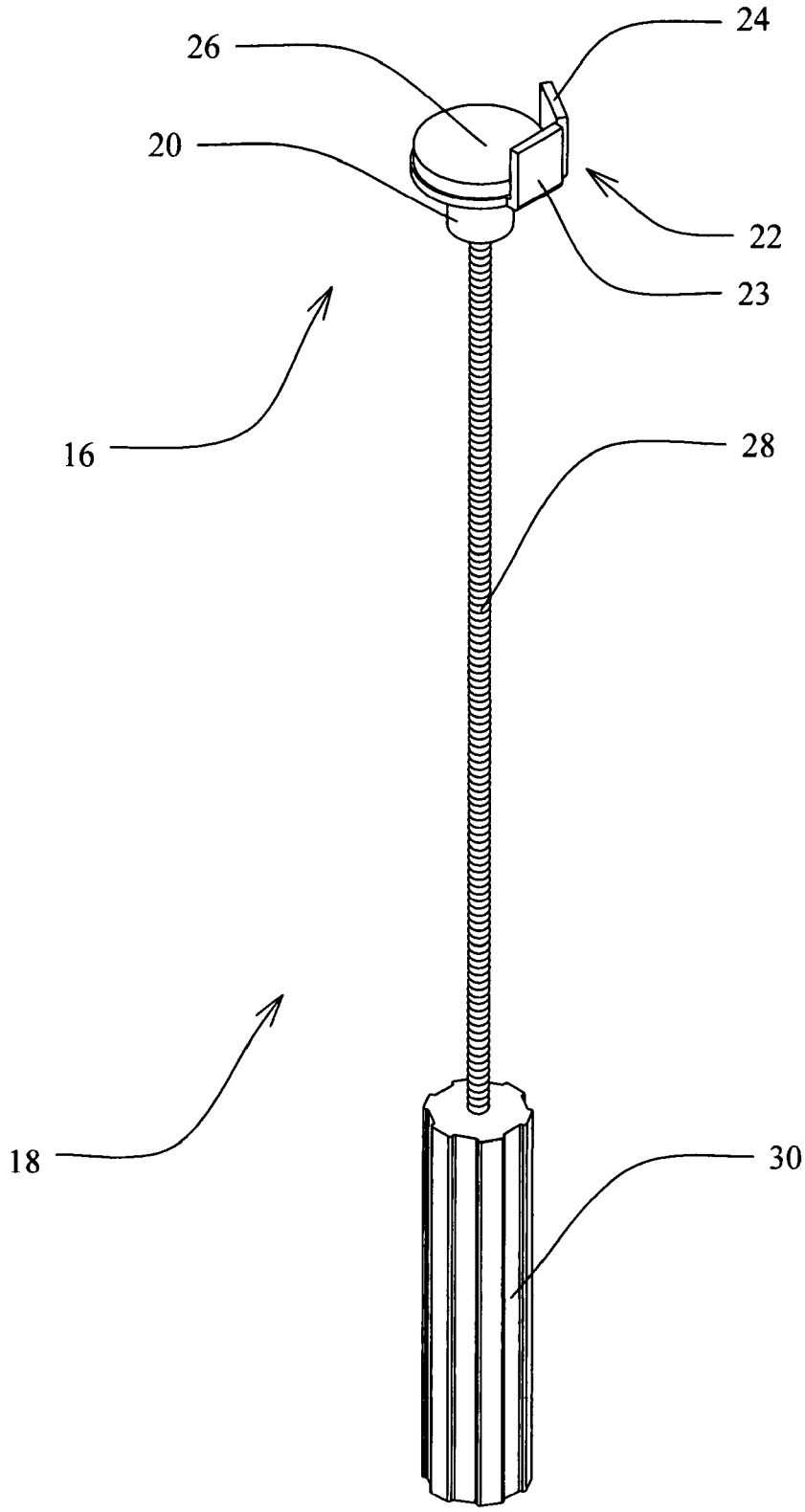
FIG. 1 is a side perspective view showing a preferred embodiment of the present invention in a relaxed state comprising an independent permanent magnet.
Figure 1A:
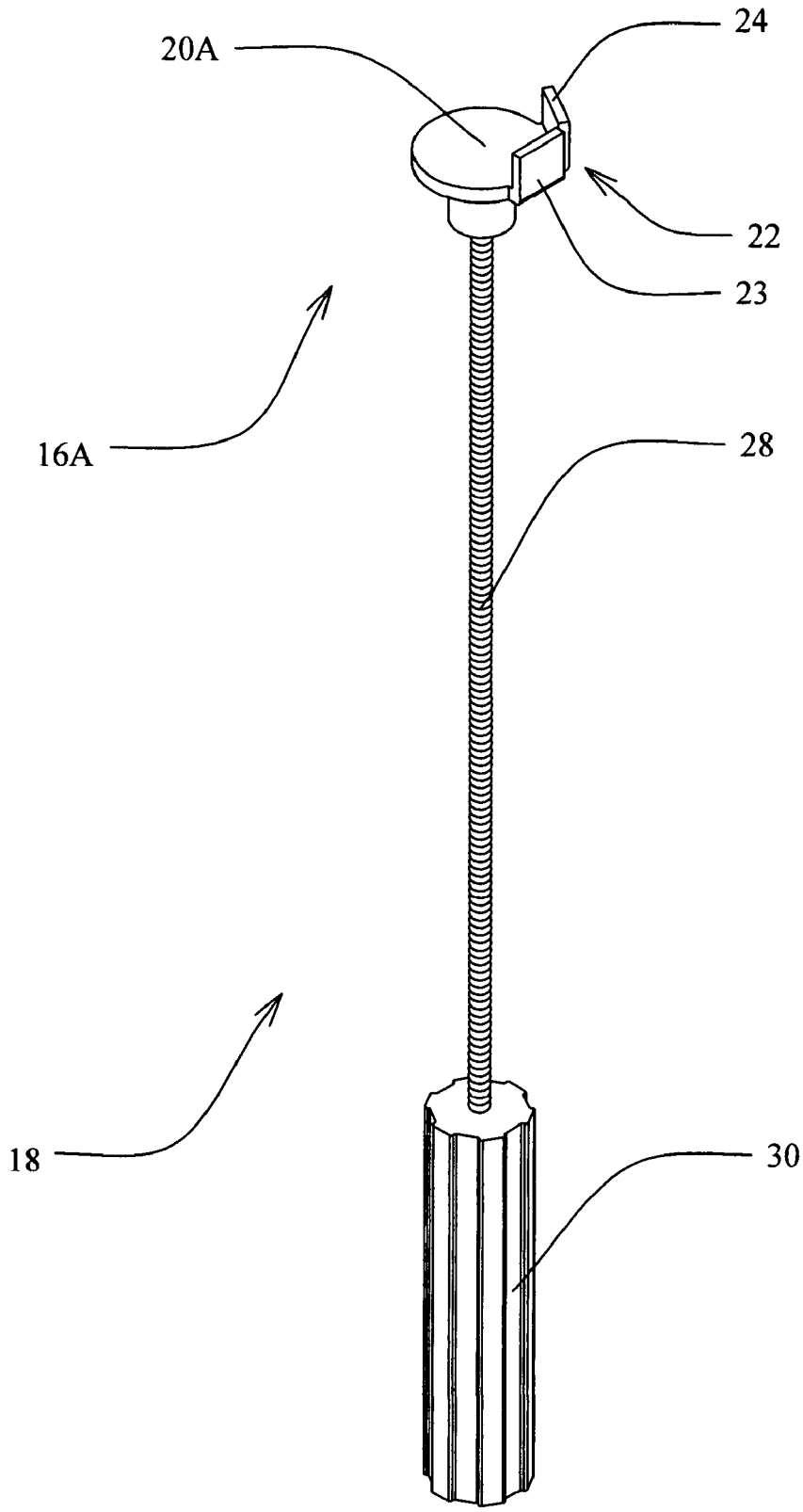
FIG. 1A is a side perspective view showing the preferred embodiment of the present invention in a relaxed state without an independent permanent magnet.
Figure 2A:
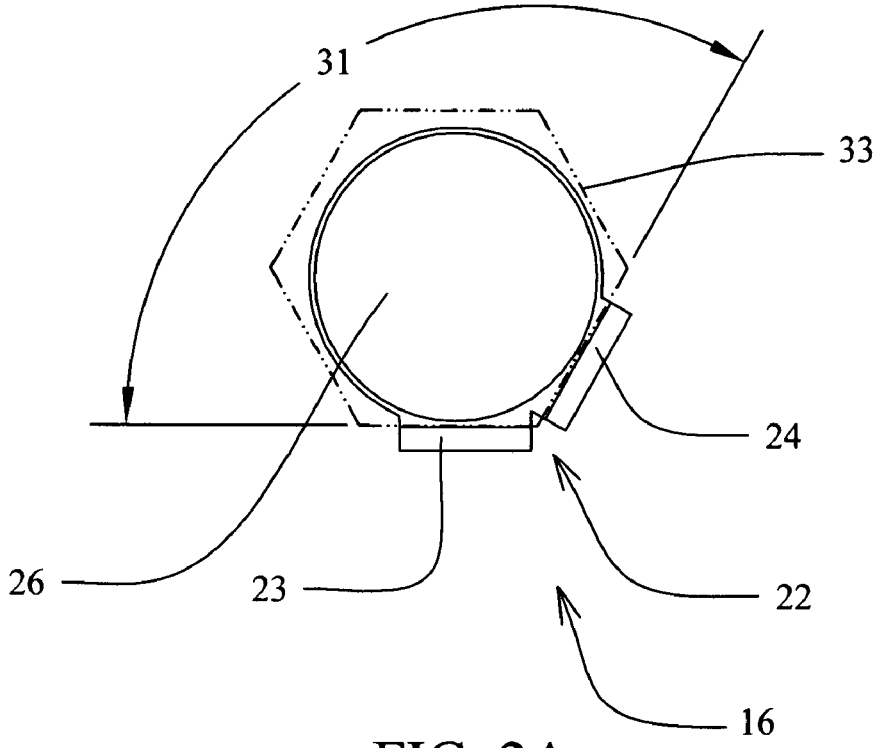
FIG. 2A is a representative top view of the preferred embodiment.
Figure 2B:
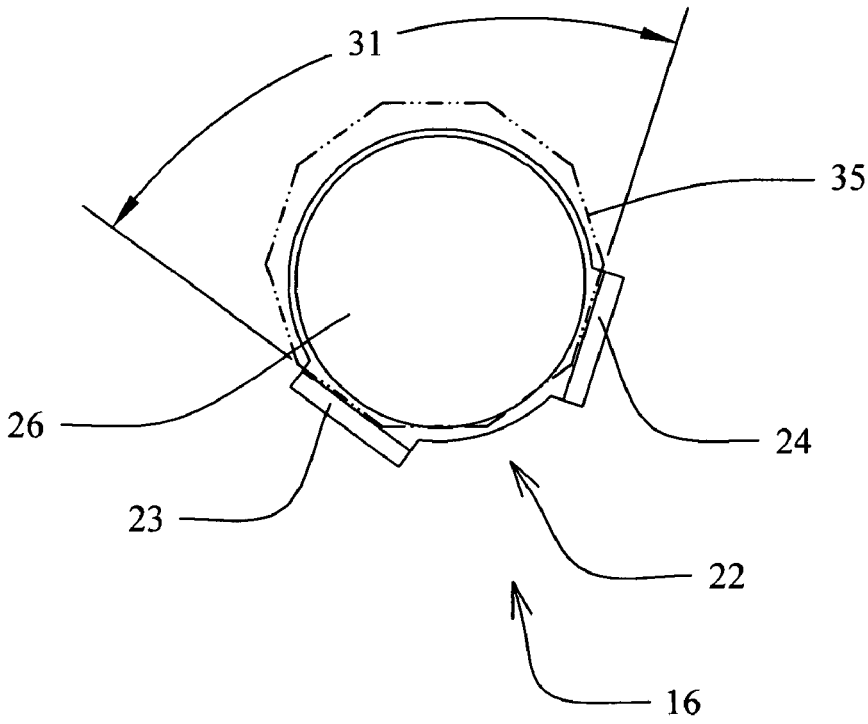
FIG. 2B is an alternate representative top view of the preferred embodiment.
Figure 3:
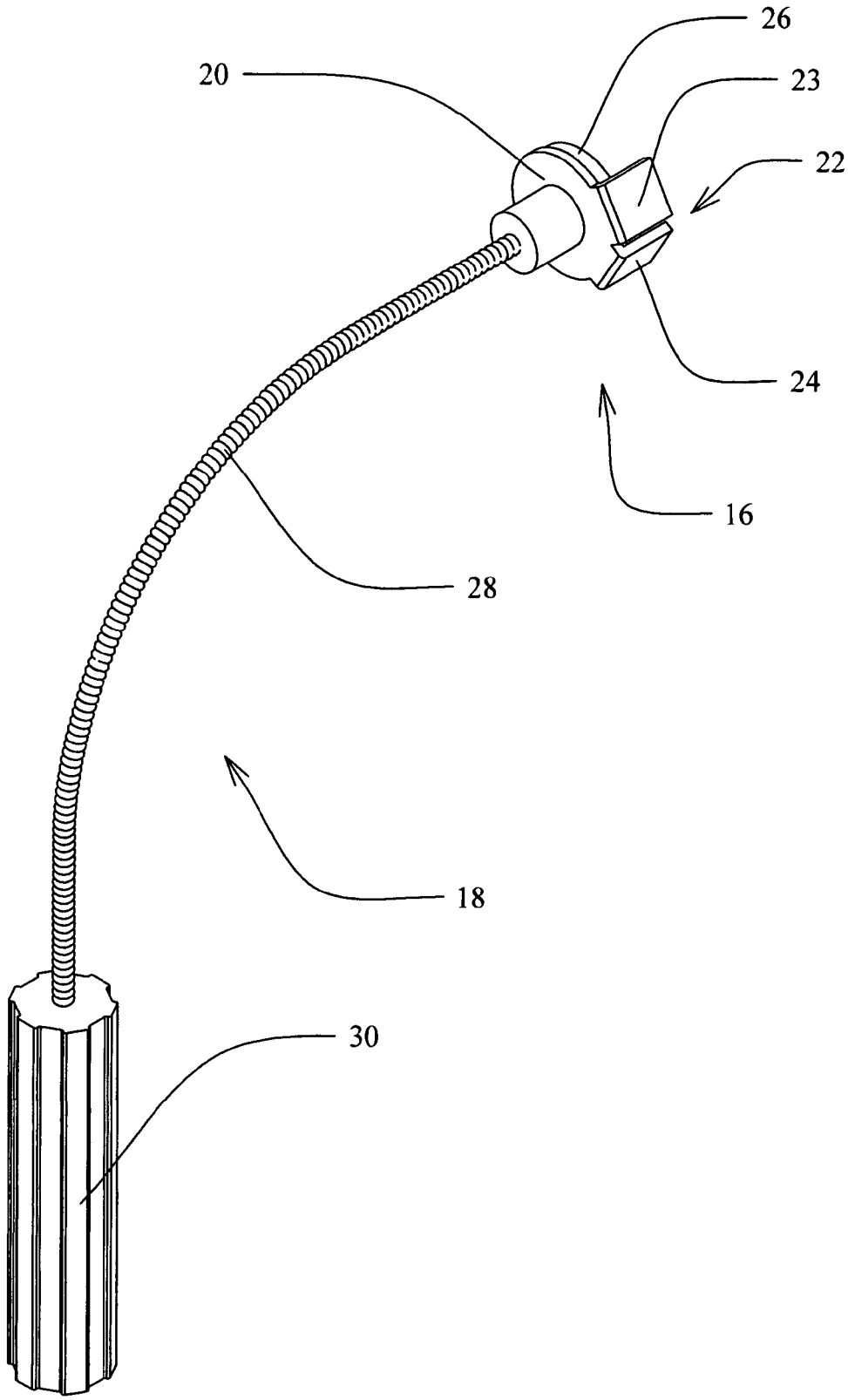
FIG. 3 is a side perspective view showing the preferred embodiment in a flexed state.
Figure 4:
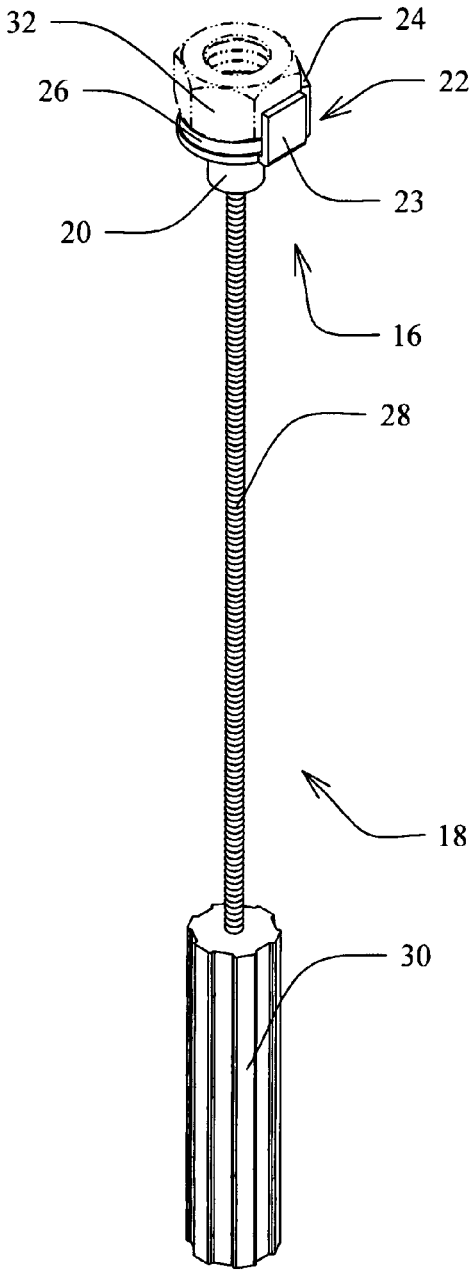
FIG. 4 is a side perspective view showing a hex nut magnetically engaged with the preferred embodiment.
Figure 5:
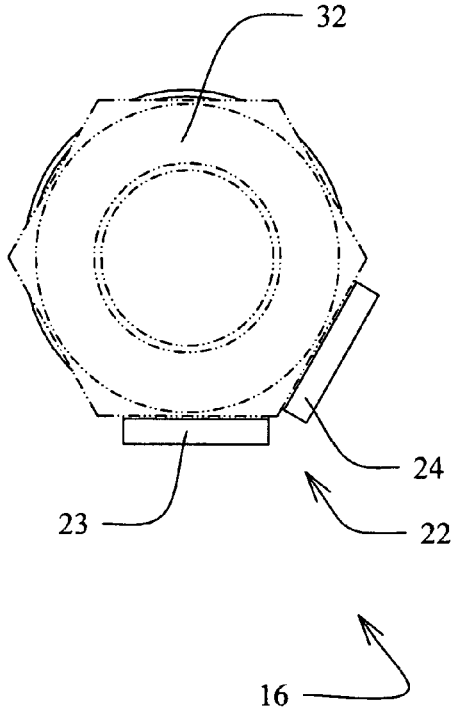
FIG. 5 is a top view showing the hex nut magnetically engaged with the preferred embodiment.

Referring to FIG. 1, FIG. 1A, FIG. 2A, FIG. 2B, and FIG. 3, a preferred embodiment of the present invention is shown. FIG. 1 shows a side perspective view of the present invention in a relaxed or unflexed state comprising an independent permanent magnet. FIG. 1A shows a side perspective view of the present invention in a relaxed or unflexed state without an independent permanent magnet. FIG. 2A shows a representative top view of the present invention and FIG. 2B shows an alternate representative top view of the present invention. FIG. 3 shows a side perspective view of the present invention in a flexed state. As shown in FIG. 1, the preferred embodiment, according to the present invention, comprises a head assembly 16 and a drive assembly 18. The head assembly 16 comprises a head 20, a magnetic pole extension piece 22, and an independent permanent magnet 26. The magnetic pole extension piece 22 comprises a magnetic pole extension piece half 23 and a magnetic extension pole piece half 24 that form an obtuse angle 31 with respect to each other. The drive assembly 18 comprises a reboundable flexible shaft 28 and a handle 30. The top end of the flexible shaft 28 is attached to the lower side of the head 20 and the lower side of the permanent magnet 26, preferably of a disc configuration, is attached to the top side of the head 20. The permanent magnet 26 is coaxially attached to the head 20. The pole extension piece 22 attaches to the upper outer perimeter of the head 20 such that it is positioned beyond the outer perimeter of the magnet 26. The vertical length of the pole extension piece 22 is such that its height extends above the top of the magnet 26.

The angle 31 formed between the inner face of the pole extension piece half 23 and the inner face of the pole extension piece half 24 is approximately equal to the absolute value of 180°-360° m/n, where n≧2m+1, "n" is a positive whole number representing the number of sides of the prismatic shape, and "m" is a positive whole number representing the number of sides from a reference side on the prismatic shape. The pole extension piece half 23 and the pole extension piece half 24 shown in FIG. 2A have an angle 31 applicable to adjacent sides (first side from a reference side) of a 6 sided prismatic shape 33 (shown as an outline for illustration) and therefore, the angle 31 shown is equal to 180°-360°×⅙=120°. If for example, the pole extension piece 22 had to connect to the third side from a reference side of a 10 sided prismatic shape 35 (shown as an outline for illustration), the angle 31 would be 180°-360°×3/10=72°, as shown in FIG. 2B. The pole extension piece 22 is manufactured from a ferro-magnetic material, such as steel, to conduct the magnetic field into sides of the magnetic object's prismatic shape being magnetically engaged with the head assembly 16. The pole extension piece half 23 and the pole extension piece half 24 can be separated from each other (discontinuous), as shown, or joined (continuous). Alternately, as shown in FIG. 1A, the independent permanent magnet 26 can be eliminated by replacing the head assembly 16 with a head assembly 16A that comprises a head 20A in which the head 20A is permanently magnetized. The head assembly 16A still comprises the magnetic pole extension piece 22 which is attached to the outer perimeter of the head 20A. The top end of the flexible shaft 28 is attached to the lower side of the head 20A. The preferred embodiment has the same function regardless of whether the head assembly 16 or the head assembly 16A is used. In the following text and figures, the preferred embodiment comprising the head assembly 16 will be used. The top side of the handle 30 is coaxially attached to the bottom end of the flexible shaft 28. The flexible shaft 28 is preferably manufactured from steel and the handle 30 is preferably manufactured from a light weight rigid material, such as plastic.

Operation of the Preferred Embodiment

FIG. 2A, FIG. 2B, FIG. 3, FIG. 4, FIG. 5, FIG. 6 and FIG. 7

Most fasteners, bolts, nuts, plugs, screws, and the like are magnetic with at least a portion thereof having substantially prismatic shapes with 2 sides orientated, with respect to each other, at an angle that is approximately equal to the absolute value of 180°-360° m/n, where n≧2m+1, "n" is a positive whole number representing the number of sides of the prismatic shape, and "m" is a positive whole number representing the number of sides from a reference side on the prismatic shape. Since the angle 31 between the pole extension piece half 23 and pole extension piece half 24 conform to this spaced relationship, an infinite number of preferred embodiment pole extension piece half configurations exist, one to match 2 sides of all prismatic shapes. In the following explanation of the preferred embodiment operation, fasteners, bolts, nuts, plugs, screws, and the like incorporating hex prismatic shapes will be used as well as a pole extension piece 22 configuration applicable to adjacent sides (first side from a reference side) of a prismatic shape. The explanation of operation for fasteners, bolts, nuts, plugs, screws, and the like with other prismatic shapes is the same.

In operation, the end of a prismatic shape of a magnetic object, such as an end of a magnetic hex nut 32, is placed in contact with and magnetically attracted to the magnetic 26. The magnetic field from the magnet 26 is conducted through the pole extension piece halves 23 and 24 and into the hex nut 32, which in turn pulls 2 prismatic sides of the nut 32 toward and into alignment with the pole extension piece halves 23 and 24, until the 2 sides of nut 32 are in full contact with the pole extension piece halves 23 and 24. The nut 32 is now firmly engaged with the head assembly 16 and therefore, reasonable torque can be applied by the shaft 28 and the handle 30 to screw and unscrew the nut 32 on and off its mating counterpart. Required alignment of nut 32 with its mating counterpart is maintained by the flexibility of the shaft 28. Note that the preferred embodiment is universal in that all hex headed fasteners, bolts, nuts, plugs, screws, and the like of different sizes will fit on the preferred embodiment configuration with the pole extension pieces halves 23 and 24 orientated 120 degrees with respect to each other. Likewise, note that the same universal characteristics of the preferred embodiment apply to all prismatic shapes of varying sizes having a common angle between 2 sides.

The small, unique, flexible, and universal design of the preferred embodiment makes the accomplishment of tedious, difficult, awkward, and messy operations a simple and easy job. With a threaded fastener, bolt, nut, plug, screw, or the like attached to the preferred embodiment, remote placement, initial installation, and/or final removal can be easily performed in locations of limited access due to (1) the relatively small size of the preferred embodiment, (2) the strong attraction and hence, strong holding power of the magnet 26 and the pole extension piece halves 23 and 24, (3) the flexibility of the shaft 28, and (4) the capability for the extreme off axis rotation of the handle 30.

In many operations, a magnetic washer, spacer, or the like has to be installed prior to the installation of a nut or bolt in areas of limited access and at adverse orientations were, for example, the washer will fall off prior to installation of the nut or bolt, hence, making the installation of both the nut or bolt and washer very difficult. With the preferred embodiment, this operation is easy. Since the magnet 26 is of high strength, its magnetic field is conducted through the nut 32 and therefore, a washer 37 can be magnetically held on the nut 32 at any orientation (due to the strong magnetic field of the magnet 26 exiting the nut 32 and entering the washer 37) and with full alignment maintained while the nut 32 and washer 37 are installed in one operation.

Other operations require that a threaded fastener, bolt, nut, plug, screw, or the like be installed in an area of limited access where a tool or a person's fingers will not fit, making the initial installation of a nut on a bolt, for example, a challenge. In addition, if a ratchet wrench and socket are used for initial installation of the nut, usually the torque required to rotate the nut is less that the torque required to operate the ratchet mechanism, resulting in the nut not being able to be screwed unless a person's finger is placed on the socket or rotating portion of the wrench to increase the effective torque required for the wrench to ratchet and screw the nut. In remote locations of limited access usually a finger cannot be placed on the socket or rotatable portion of the wrench making the nut installation process difficult. Again, with the preferred embodiment, this operation is simple. With the fingers of one hand holding the handle 30 and the fingers of the other hand holding and positioning the shaft 28, the nut 32 can be easily positioned and aligned with the corresponding bolt, due to the flexibility of shaft 28, and self started by rotation of the handle 30. The final removal of the nut 32 is also easy because the above ratchet wrench torque problems are eliminated and the nut 32 remains magnetically attracted to the preferred embodiment after removal, therefore, preventing loss of the nut 32.

Figure 6:
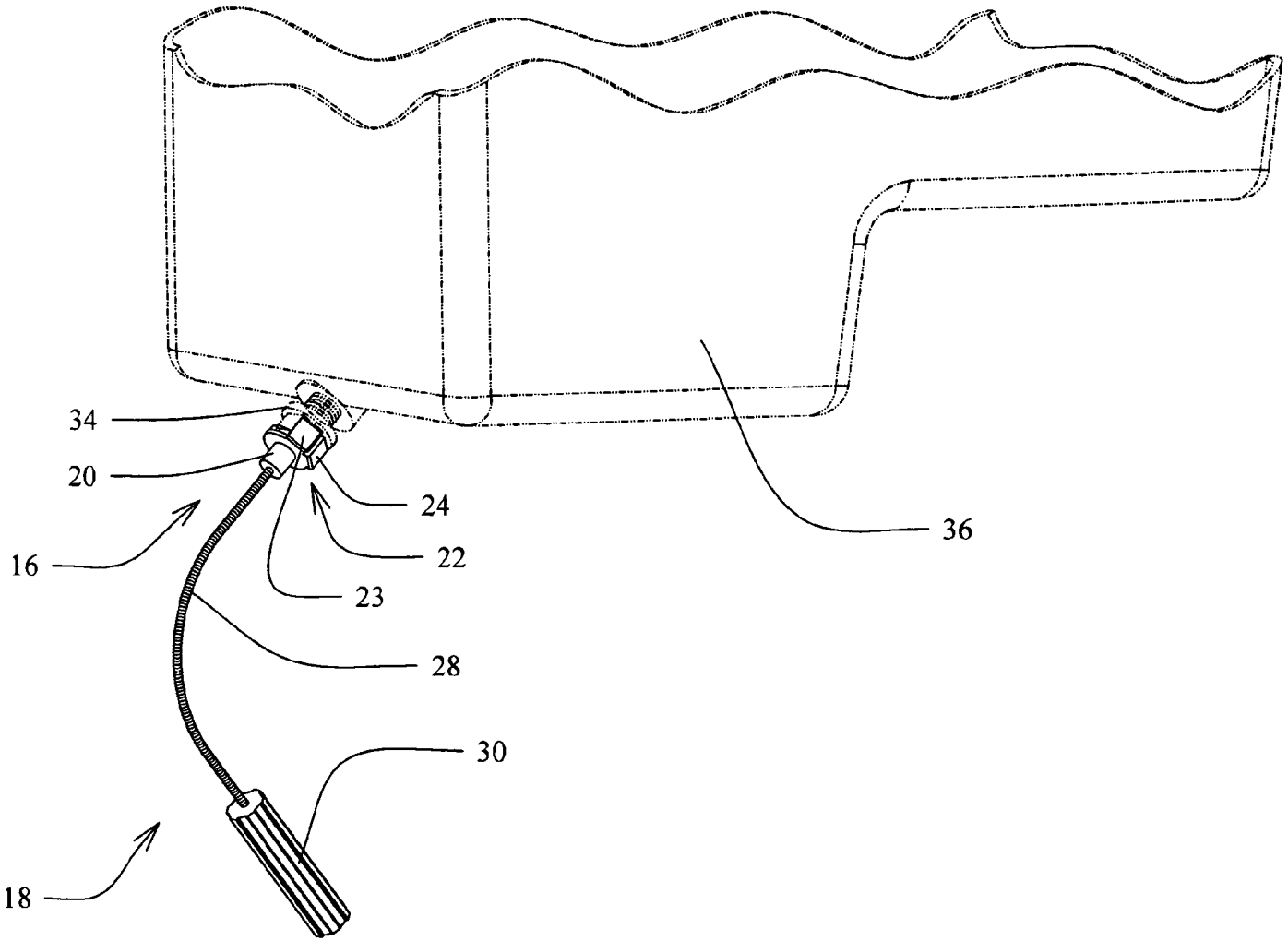
FIG. 6 is a side perspective view showing the preferred embodiment being used to remove an oil drain plug from an engine oil pan.
Figure 7:
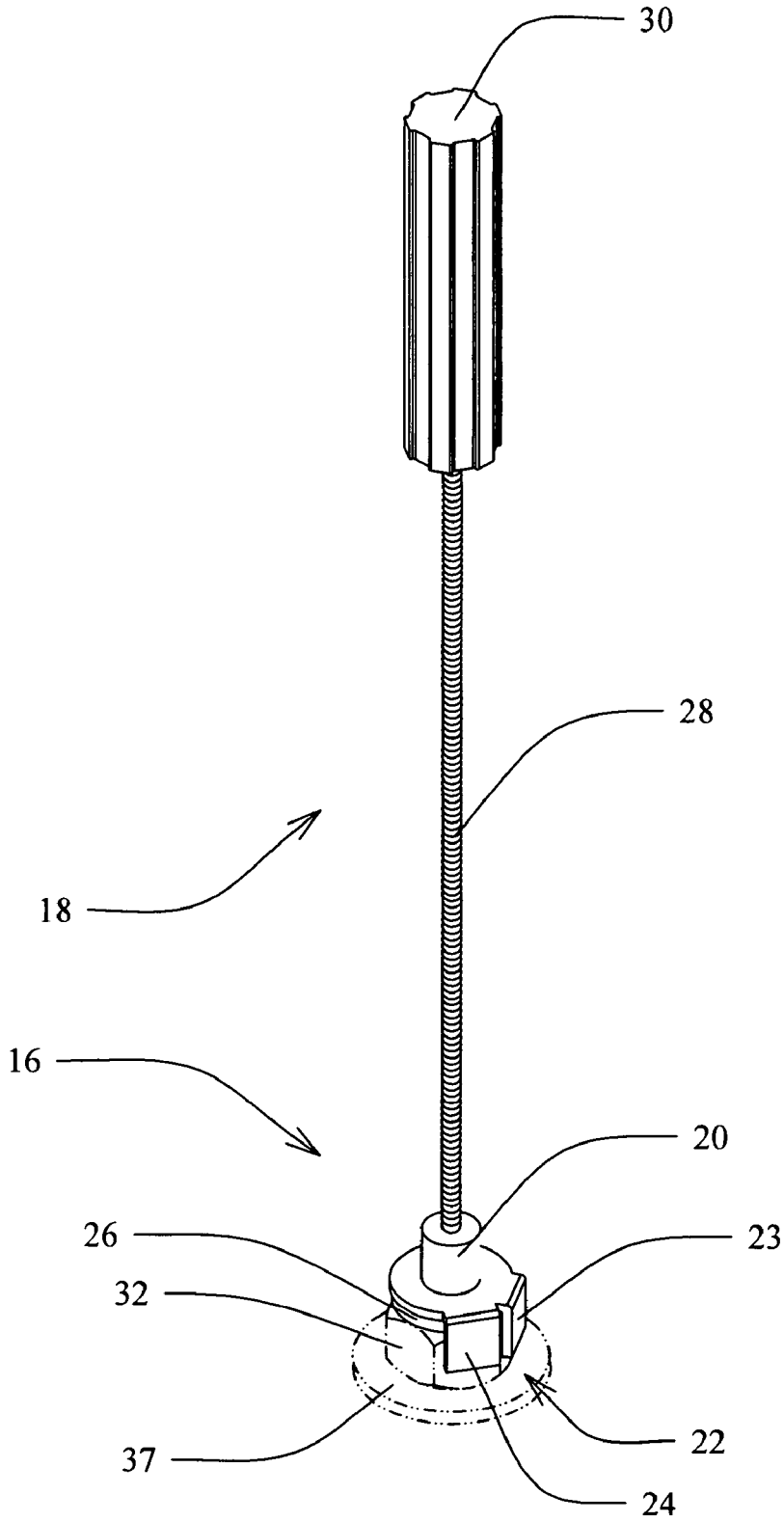
FIG. 7 is a side perspective view showing a hex nut and a washer connected to the preferred embodiment for subsequent initial installation of the nut and the washer in the downward direction.

Another extremely useful application of the preferred embodiment is to remove oil drain plugs from oil drain pans on engines, transmissions, and the like. With respect to the conventional removal of drain plugs on engines in vehicles, especially cars and trucks, there are many problems, some of them relating to safety. In a typical oil draining process on a vehicular engine, the engine is ran for several minutes to heat the oil so that it will more easily flow from the engine's drain pan. After the oil is hot, the engine is stopped and an oil drain container is placed under the engine's drain plug. The vehicle may require jacking and the use of jack stands. The drain plug is then loosened with a wrench and hand unscrewed and removed allowing the oil to drain into the drain container. Usually, a number of adverse problems occur during a typical oil changing process, namely; the hot oil flowing on a person's hand causing burning and/or irritation; hot oil possibly splashing into a person's eyes causing severe damage; the drain plug falling into the oil drain container requiring messy removal; and/or oil splashing onto the floor requiring cleaning. These problems and the possible requirement for jacking the vehicle can be eliminated with the use of the preferred embodiment. Referring to FIG. 6, a side perspective view showing the preferred embodiment of the present invention being used to remove an oil drain plug 34 from an engine's oil pan 36 is shown. With the preferred embodiment, the drain plug 34 is loosened with a conventional wrench. The head assembly 16 of the preferred embodiment is magnetically engaged with the drain plug 34. The shaft 28 is then flexed to place the handle 30 in a desirable remote location and orientation. Next, the drain plug 34 is unscrewed by rotating the handle 30. After the drain plug 34 has been fully unscrewed, the plug 34 automatically falls downward by the force of gravity until limited by the flexing of the shaft 28 and out of the way of the oil stream. It is emphasized that (1) by remote removal of the plug 34, body contact with the hot oil is essentially eliminated, (2) oil splashing, if any, is negligible due to the automatic and quick removal of the plug 34 from the oil stream, and (3) the plug 34 does not fall in the drain container since the plug 34 remains engaged with the preferred embodiment. The requirement for jacking the vehicle is not normally required since the preferred embodiment removes the drain plug 34 remotely from off axis orientations and therefore, usually the arm is the only part of the body that has to be placed under the vehicle.

First Alternate Embodiment

FIG. 8

Figure 8:
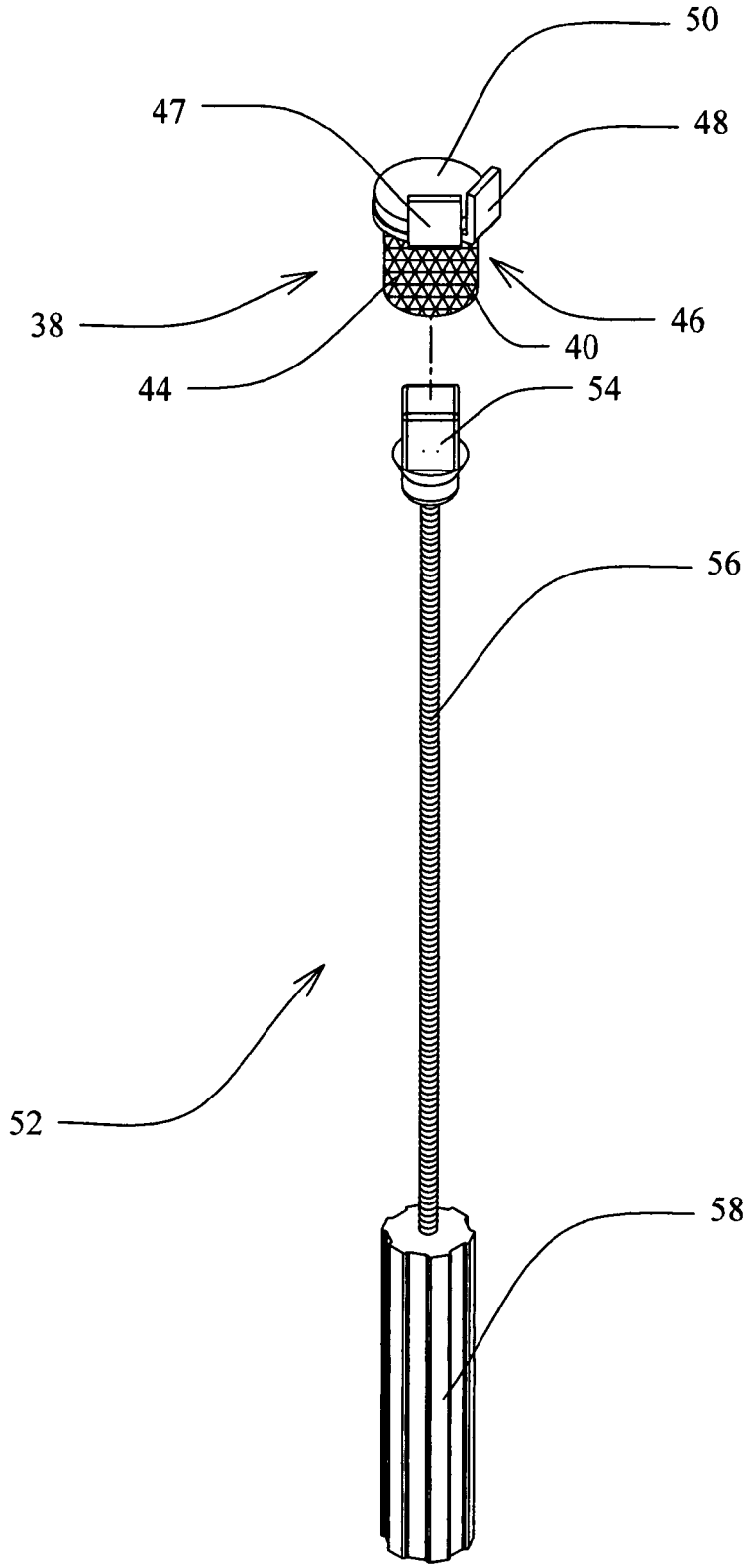
FIG. 8 is a partially exploded side perspective view of a first alternate embodiment of the present invention.

Referring to FIG. 8, a first alternate embodiment of the present invention is shown. The first alternate embodiment, according to the present invention, comprises a head assembly 38 and a driver assembly 52. The head assembly 38 comprises a head 40, a magnetic pole extension piece 46, and a high strength permanent magnet 50. The magnetic pole extension piece 46 comprises magnetic pole extension piece half 47 and a magnetic pole extension piece half 48. The pole extension piece half 47 and the pole extension piece half 48 can be separated from each other (discontinuous), as shown, or joined (continuous). The head 40, the pole extension piece 46, the pole extension piece half 47, the pole extension piece half 48, and the magnet 50 are configured, connected, and orientated, respectively to each other in the same manner as the head 20, the pole extension piece 22, the pole extension piece half 23, the pole extension piece half 24, and the magnet 26, respectively, are in the preferred embodiment. In the same manner as with the preferred embodiment, the magnet 50 can be eliminated and the head 40 permanently magnetized. In addition, the pole extension piece 46 is manufactured from the same material as the pole extension piece 22 of the preferred embodiment. The head 40 has two differences from the head 20, namely, a socket 42 in its lower side (see FIG. 9 and FIG. 10) and a knurl 44 on its outer circumferential surface. The driver assembly 52 comprises a drive post 54, a reboundable flexible driver shaft 56, and a handle 58. The lower side of the drive post 54 is connected coaxially with the upper end of the shaft 56 and the lower end of the shaft 56 is connected coaxially with the handle 58. The socket 42 is designed to accommodate the drive post 54.

Operation of the First Alternate Embodiment

Figure 9:
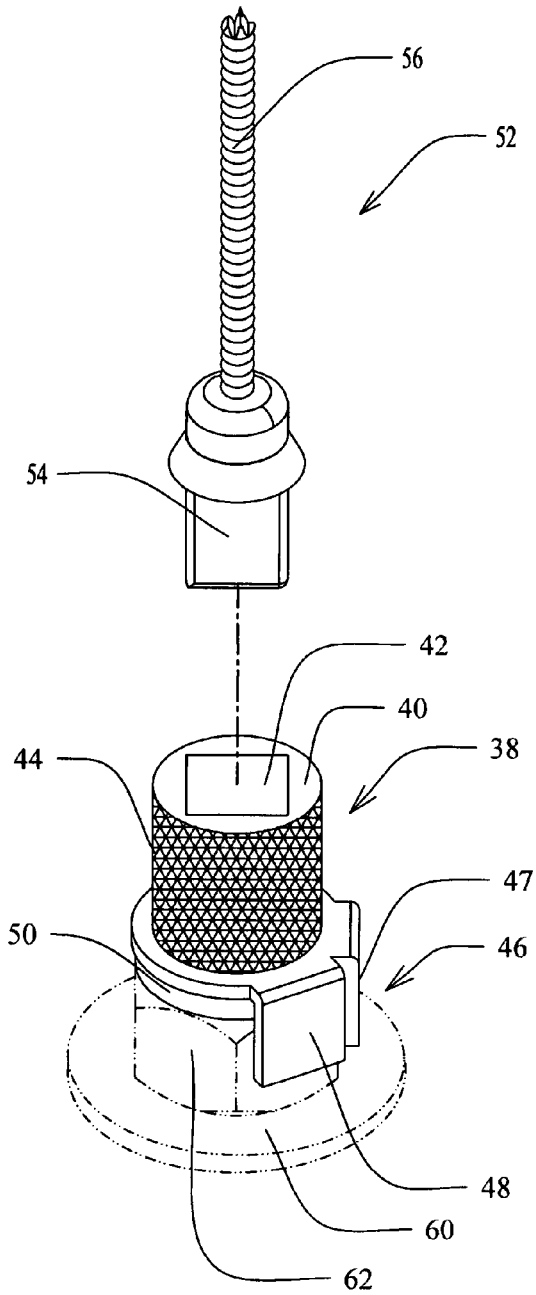
FIG. 9 is a partially exploded side perspective view showing a hex nut and a washer connected to the first alternate embodiment for subsequent initial installation of the nut and the washer in the downward direction.
Figure 10:
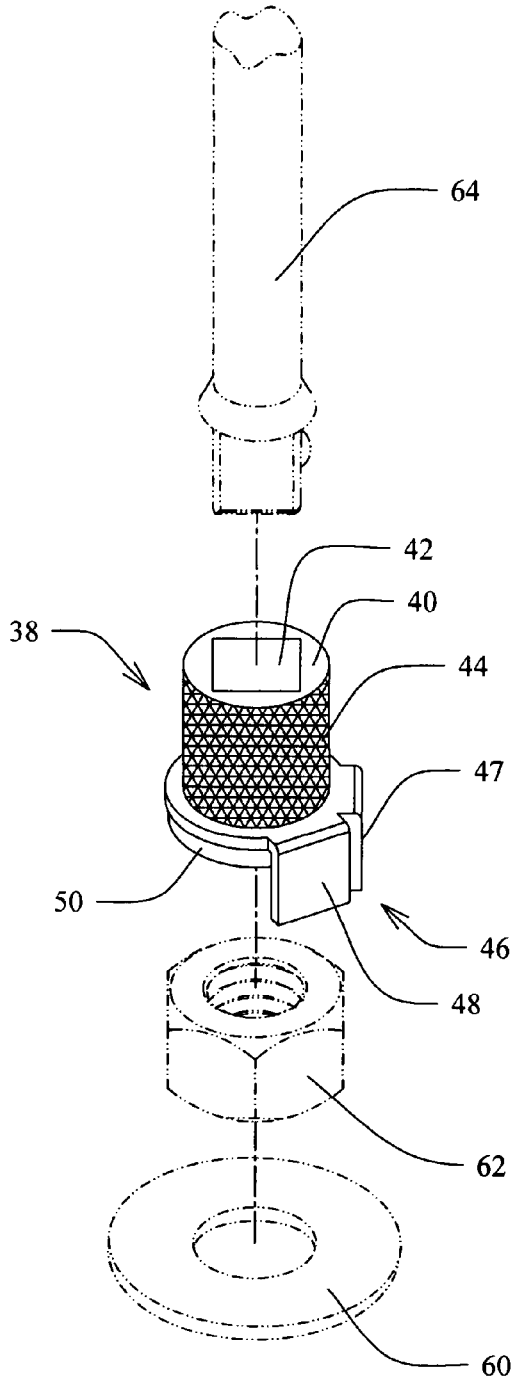
FIG. 10 is a partially exploded side perspective view showing a hex nut, a washer, and a socket wrench extension bar connected to a head assembly of the first alternate embodiment for subsequent initial installation of the nut and the washer in the downward direction.

FIG. 8, FIG. 9, and FIG. 10

In general, the operation and uses of the first alternate embodiment are the same as the preferred embodiment with the exception that the head assembly 38 of first alternate embodiment can be positioned and rotated in one of 3 ways, namely by finger rotation; by use of a socket wrench without or with accessories, such as a ratchet wrench and extension bar, connected to the socket 42; and by use of the driver assembly 52. Engaging an end of the prismatic shape of a fastener, bolt, nut, plug, screw, and the like with the head assembly 38 is exactly the same as with the preferred embodiment. When the head assembly 38 is coupled to the driver assembly 52 by inserting the drive post 54 into the socket 42, the combined assembly essentially functions the same as the preferred embodiment, therefore, operation and uses are the same as with the preferred embodiment. In some instances, access may be limited but does not require remote rotation. In this case, the driver assembly 52 is not used and the head assembly 38 is manually rotated by finger contact with the knurl 44. In other instances, access may or may not be limited but requires significant remote positioning and rotation of the head assembly 38 using socket wrenches with or without accessories connected to the socket 42. In a manner similar to the preferred embodiment, FIG. 9 shows the first alternate embodiment made ready for initial installation of both a nut 62 and a washer 60 in the downward direction, while maintaining the nut 62 to the washer 60 alignment. FIG. 10 shows an extension bar 64 coupled to the head assembly 38 for initial installation of the nut 62 and the washer 60 in a downward direction. In addition, the driver assembly 52 can be used with conventional sockets and socket accessories to remotely perform placement, initial installation, and/or final removal of fasteners, bolts, nuts, plugs, large screws, and the like in locations of limited access.

Second Alternate Embodiment

Figure 11:
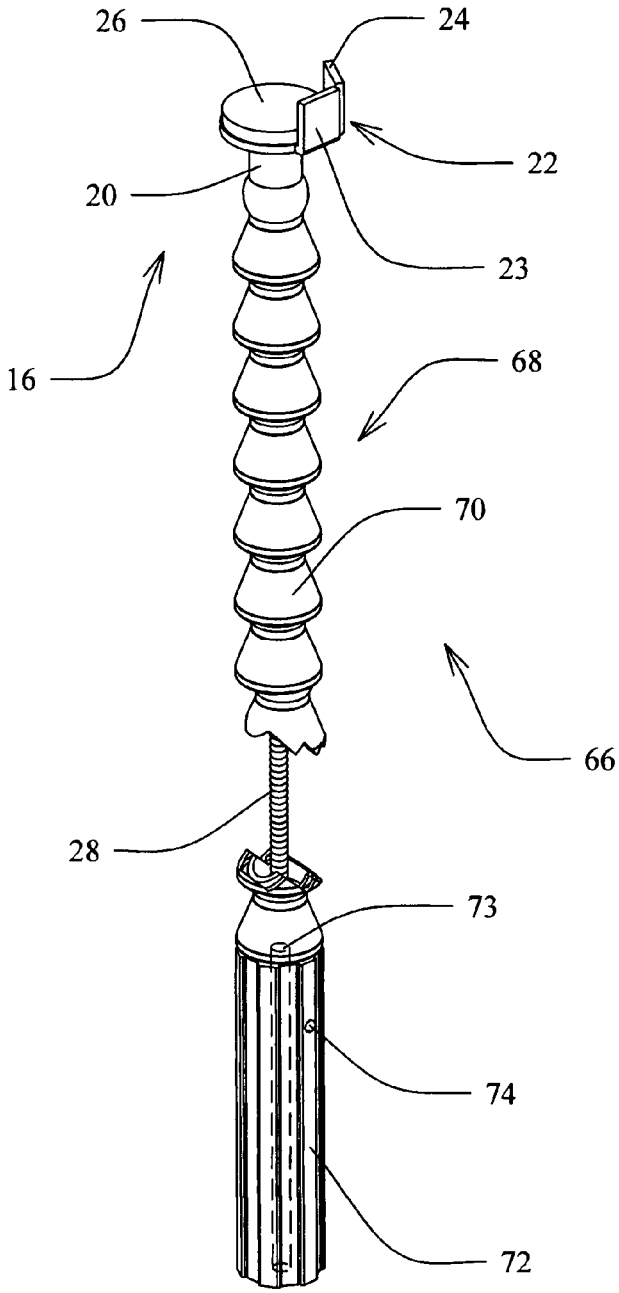
FIG. 11 is a side perspective view showing a second alternate embodiment of the present invention in a generally straight configuration.
Figure 12:
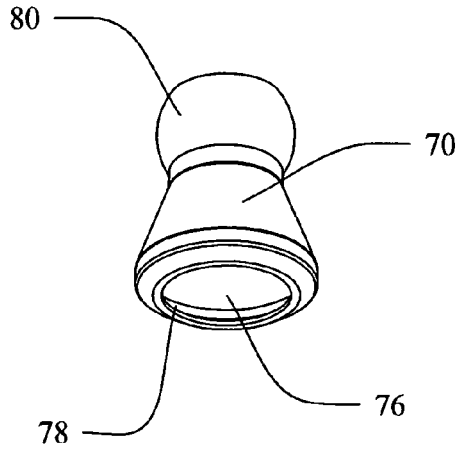
FIG. 12 is a side perspective view of a modular link in an adjustable arm used in the second alternate embodiment.
Figure 13:
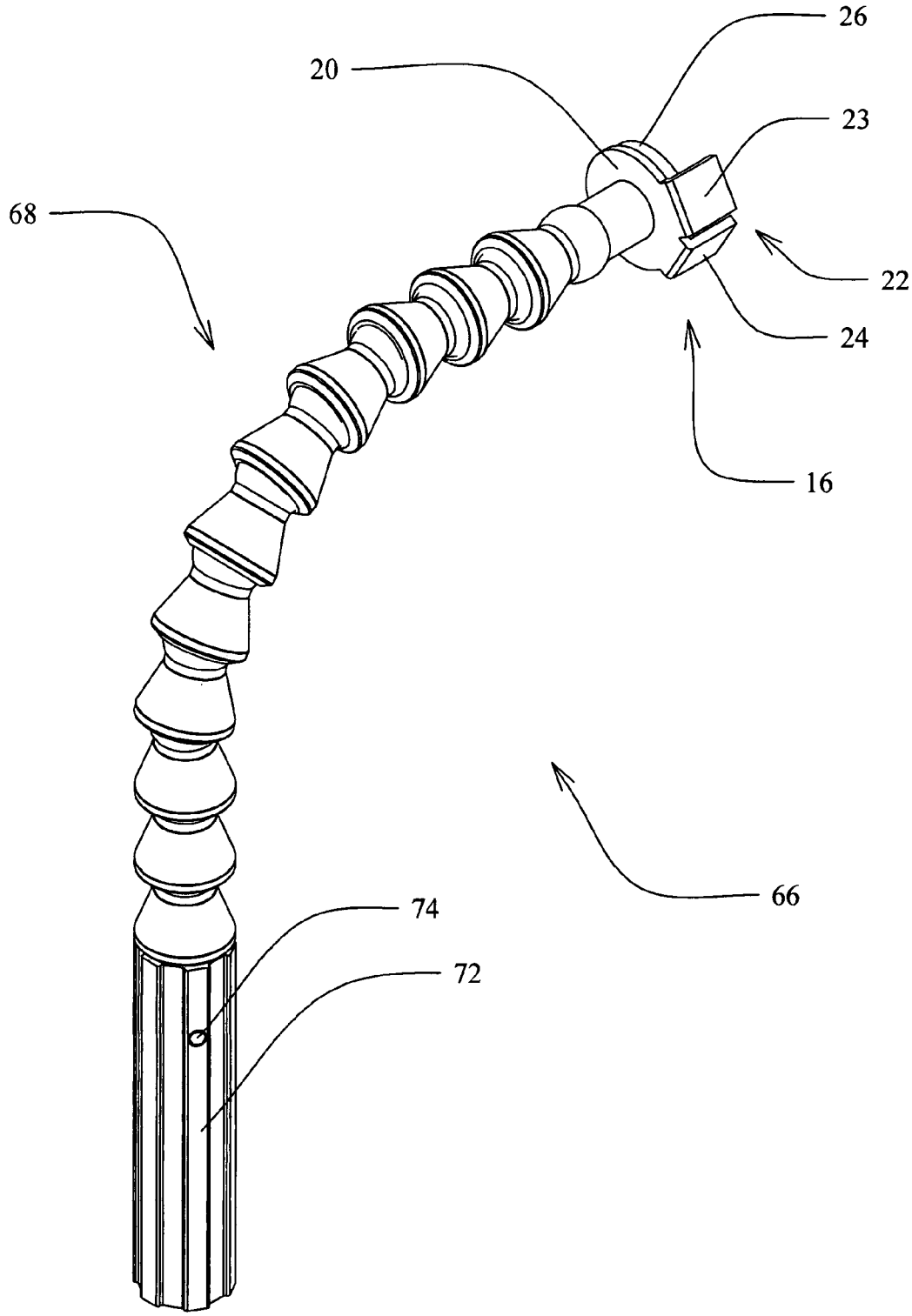
FIG. 13 is a side perspective view showing the second alternate embodiment in a curved configuration.

FIG. 11, FIG. 12, and FIG. 13

Referring to FIG. 11, FIG. 12, and FIG. 13, a second alternate embodiment of the present invention is shown. FIG. 11 shows a side perspective view of the second alternate embodiment of the present invention in a straight configuration and FIG. 13 shows a side perspective view of the second alternate embodiment in a curved configuration. The second alternate embodiment, according to the present invention, comprises the head assembly 16 or 16A of the preferred embodiment, and a drive assembly 66. The drive assembly 66 comprises the flexible shaft 28 used in the preferred embodiment, an adjustable modular arm assembly or semi-rigid adjustable arm assembly 68, and a handle 72. The flexible shaft 28 is attached to the head assembly 16 in the same manner as in the preferred embodiment. The adjustable modular arm assembly 68 comprises a number of individual links 70 connected in series with each other. FIG. 12 shows a side perspective view of one of the links 70. Each of the links 70 comprises a ball end 80, a socket end 78, and a through hole 76. Each of the links 70 is connected so that the ball end 80 fits into the socket end 78 of the adjacent link 70. The design of each link 70 is such that an interference fit is maintained between the ball end 80 and the socket end 78 thereby, permitting rotation and twisting between each adjacent link 70 and the subsequent retainment of orientation between each adjacent link 70. The handle 72 comprises a through hole 73 along its center axis that accommodates the end of the flexible shaft 28, opposite from that connected to the head assembly 16, and a set screw 74 to retain the end of the flexible shaft 28 in the handle 72. The adjustable modular arm assembly 68 is assembled into the second alternate embodiment such that the flexible shaft 28 passes through each through hole 76 in each link 70 and is held in place by the bottom end of the head assembly 16 and the top end of the handle 72 by tightening the set screw 74.

Operation of the Second Alternate Embodiment

FIG. 4, FIG. 5, FIG. 6, FIG. 7, FIG. 11, and FIG. 13

In general, the operation and uses of the second alternate embodiment are the same as the preferred embodiment but with added capability. In the second alternate embodiment, the modular arm assembly 68 can be (1) configured to retain the flexible shaft 28 in a pre-configured curve and (2) removed from the second alternate embodiment resulting in the second alternate embodiment functioning essentially the same as the preferred embodiment. With the flexible shaft 28 being retained in a pre-configured curve by adjustment of the modular arm assembly 68, the second alternate embodiment has a further more controlled reach into distant areas of limited access with respect to remote placement, initial installation, and/or final removal of fasteners, bolts, nuts, plugs, large screws, and the like, than the preferred embodiment. In operation, the prismatic shape of the selected magnetic object is engaged with the head assembly 16 in the same manner as in the operation of the preferred embodiment. The modular arm assembly 68 is then configured into the required curve and the head assembly 16 placed in position to install the fastener, bolt, nut, plug, large screw, or the like. With one hand holding the modular arm assembly 68, the other hand rotates the handle 72, which in turn rotates the flexible shaft 28 and the head assembly 16, to initially install the fastener, bolt, nut, plug, large screw, or the like. Final removal of a fastener, bolt, nut, plug, large screw, or the like, is accomplished in a somewhat similar manner. To configure the second alternate embodiment like the preferred embodiment, the set screw 74 is loosened and the flexible shaft 28 removed from the handle 72. The modular arm assembly 68 is then removed from the flexible shaft 28, the flexible shaft 28 re-inserted back into the handle 72 and the set screw 74 re-tightened.

Third Alternate Embodiment

FIG. 14

Figure 14:
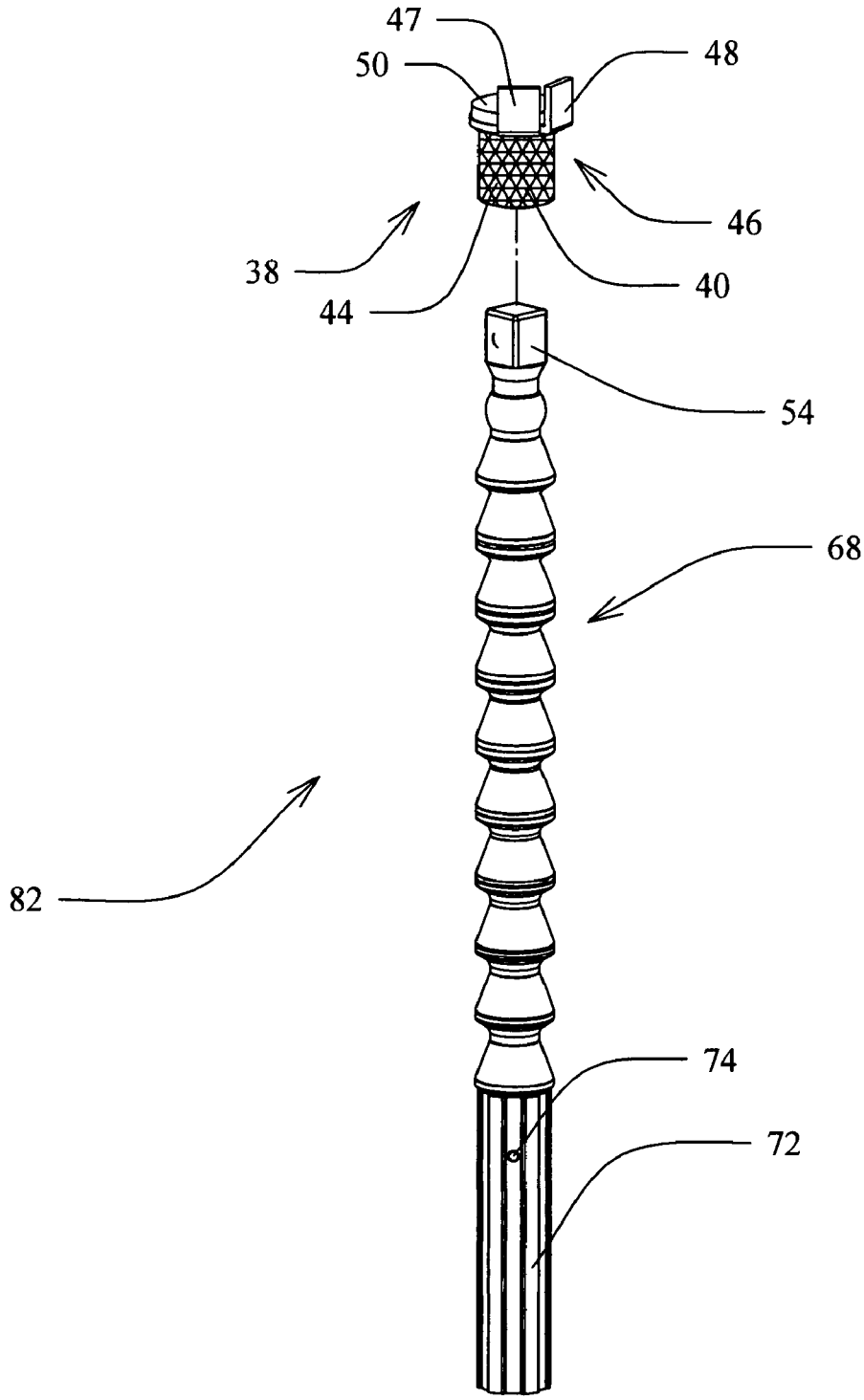
FIG. 14 is a partially exploded side perspective view of a third: embodiment of the present invention.

Referring to FIG. 14 a third alternate embodiment of the present invention is shown. FIG. 14 shows a side perspective view of the third alternate embodiment. The third alternate embodiment, according to the present invention, comprises a driver assembly 82 and the head assembly 38 of the first alternate embodiment. The driver assembly 82 comprises the drive post 54, and the flexible driver shaft 56 of the first alternate embodiment (see FIG. 8) and the adjustable modular arm assembly or semi-rigid adjustable arm assembly 68 and the handle 72 of the second alternate embodiment (see FIG. 11). The lower side of the drive post 54 is connected coaxially with the upper end of the flexible shaft 56. As with the second alternate embodiment, the flexible shaft 56 is passed through each through hole 76 in each link 70 of the modular arm assembly 68. The modular arm assembly 68 is held in place by the lower side of the drive post 54 and the top end of the handle 72 by tightening the set screw 74. The driver assembly 82 is connected to the head assembly 38 by inserting the drive post 54 into the socket 42 of the head assembly 38. In the same manner as with the preferred embodiment, the magnet 50 can be eliminated and the head 40 permanently magnetized.

Operation of the Third Alternate Embodiment

FIG. 8, FIG. 9, FIG. 10, and FIG. 14

In general, the operation and uses of the third alternate embodiment are the same as the first alternate embodiment but: with added capability. With the third alternate embodiment, the modular arm assembly 68 can be (1) configured to retain the flexible shaft 56 in a pre-configured curve and (2) removed from the driver assembly 82 resulting in the third alternate embodiment being essentially the same as the first alternate embodiment. With the flexible shaft 56 being retained in a pre-configured curve by adjustment of the modular arm assembly 68, the third alternate embodiment has a further more controlled reach into distant areas of limited access, with respect to remote placement, initial installation, and/or final removal of fasteners, bolts, nuts, plugs, large screws, and the like, than the first alternate embodiment. In operation, the drive post 54 of the driver assembly 82 is inserted into the socket 42 of the head assembly 38. Next, the prismatic shape of the selected magnetic object is engaged with the head assembly 38 in the same manner as in the operation of the first alternate embodiment. The modular arm assembly 68 is then configured into the required curve and the head assembly 38 placed in position to perform placement, initial installation, and/or final removal of a fastener, bolt, nut, plug, large screw, or the like. With one hand holding the modular arm assembly 68, the other hand rotates the handle 72, which in turn rotates the flexible shaft 56 and the head assembly 38, to initially install the fastener, bolt, nut, plug, large screw, or the like. Final removal of the fastener, bolt, nut, plug, large screw, or the like, is accomplished in a somewhat similar manner. To configure the third alternate embodiment similar to the first alternate embodiment, the set screw 74 is loosened and the flexible shaft 56 removed from the handle 72. The modular arm assembly 68 is then removed from the flexible shaft 56, the flexible shaft 56 re-inserted back into the handle 72, and the set screw 74 re-tightened. As with the first alternate embodiment, the head assembly 38 can be removed from the driver assembly 82 and used independently. In addition, the driver assembly 82 can be used with conventional sockets and socket accessories to remotely perform placement, initial installation, and/or final removal of fasteners, bolts, nuts, plugs, large screws, and the like in locations of limited access.

Fourth Alternate Embodiment

FIG. 4

The fourth alternate embodiment, according to the present invention, defines a method of manipulating a magnetic object with at least a portion thereof having a substantially prismatic shape, comprising the steps of: providing a device for manipulating the magnetic object, the device comprising the head assembly 16; positioning an end of the prismatic shape of the magnetic object on the head assembly 16; positioning two sides of the prismatic shape in contact with the magnetic extension piece 22 of the head assembly 16; retaining by magnetic attractive force, the magnetic object in position on the head assembly 16; manipulating the device to place, secure, fasten, install, and/or remove the magnetic object; and removing the magnetic object from the device. As with the preferred embodiment, the head assembly 16 can be replaced with the head assembly 16A.

Operation of the Fourth Alternate Embodiment

The operation of the fourth alternate embodiment is explained in the DETAILED DESCRIPTION OF THE EMBODIMENTS—Fourth Alternate Embodiment, above.

CONCLUSION, RAMIFICATIONS, AND SCOPE

Thus, a person of ordinary skill in the art will understand that the device and method for remotely manipulating a magnetic object, with at least a portion thereof having a substantially prismatic shape, is novel, simple, universal, as well as inexpensive and has many advantages, features, and benefits over the prior art. Furthermore, it will be readily apparent to one skilled in the art that the device and method of this invention are essential for easy and effective remote placement, initial installation, and/or final removal of a prismatic shaped magnetic object such as a fastener, bolt, nut, plug, screw, and the like in limited access locations. In addition, it will be evident that design of the head assembly of the present invention, which incorporates a magnetic pole extension piece to engage with 2 sides of a prismatic shaped magnetic object, is truly unique. Moreover, the device and method may have one or more of the additional advantages in that:

- the device will permit remote placement, initial installation, and/or final removal of both a prismatic shaped magnetic object and washer, spacer, or the like, simultaneously;
- the device will permit remote placement, initial installation, and/or final removal of prismatic shaped magnetic objects in off axis locations were device articulation is required;
- the device will positively engage with all sizes of a fixed prismatic shaped magnetic object without requiring the use of moving parts;
- the device will permit remote placement, initial installation, and/or final removal of prismatic shaped magnetic objects in adverse locations were pre-adjusted flexible shaft articulation is required to remain fixed;
- the device will permit the remote removal of prismatic shaped drain plugs while limiting the possibility of hot oil or other drained liquid from contacting the hands and/or arms; and
- the method defines a simple and effective process for remote placement, initial installation, and/or final removal of magnetic objects with prismatic shapes, such as fasteners, bolts, nuts, plugs, screws, and the like in distant and limited access locations.

Although the description above contains many specificities, these should not be construed as limiting the scope of the invention but as merely providing illustrations of some of the presently disclosed embodiments of this invention. Many other ramifications, variations, alterations, substitutions, modifications, and the like are readily possible within the teachings of the invention. For example, sizes, shapes, materials, assembly, design, etc. of all parts can be readily modified or changed; magnetic pole extension piece halves 23 and 24 can be configured to articulate about the head to accommodate prismatic shapes with varying numbers of sides; magnetic pole extension piece halves 47 and 48 can be configured to articulate about the head 40 to accommodate prismatic shapes with varying numbers of sides; there can be more than one magnetic pole extension piece 22 on head 20 to accommodate prismatic shapes with varying numbers of sides; there can be more than one magnetic pole extension piece 46 on head 40 to accommodate prismatic shapes with varying numbers of sides; in the preferred embodiment, the drive assembly 18 can be separated from the head assembly 16 and the head assembly 16 used independently to finger manipulate the head assembly 16 to install and remove fasteners, bolts, nuts, plugs, screws, and the like; the permanent magnet 26 can be replaced with an electromagnet, the handle 30 modified to incorporate a related electrical switch and to include a cavity for housing related batteries, and the flexible shaft 28 modified to accommodate related electrical wiring; the head assembly 16 and the head assembly 16A can include a light for illumination of the work area; the head assembly 38 can include a light for illumination of the work area; the head 20 can be a permanent magnet itself and therefore, the permanent magnet 26 eliminated; the head 40 can be a permanent magnet itself and therefore, the permanent magnet 50 eliminated; the magnet 26 can be integrated internally within the head 20; the magnet 50 can be integrated internally within the head 40; the magnetic pole extension piece halves 23, 24, 47, and 48 can be replaced with permanent magnets; the magnetic pole extension piece halves 23, 24, 47, and 48 can have a curved surface rather than a planar surface; the adjustable arm assembly 68 can be of a design similar to that of the flexible zone 16 of U.S. Pat. No. 3,409,224, issued Nov. 5, 1968 to Harry J. Harp, Walter T. Leible, and William M. McCort; and the adjustable arm assembly 68 can be replaced with an adjustable arm assembly of any design and/or material that can withstand continuous flexing and twisting without degradation of the adjustable arm assembly's ability to retain a pre-configured curve. The drive assembly 18, the drive assembly 66, the driver assembly 52, and the driver assembly 82 should be construed as drivers.

Thus, the scope of the invention should be determined not by the embodiments illustrated or examples given, but by the appended claims and their legal equivalents.

I claim:

1. A device for manipulating a magnetic object, at least a portion of the magnetic object having a substantially prismatic shape with at least two side surfaces and an end surface, the device comprising: a head having a magnetic field and an axis of rotation, said head comprising a face contact surface oriented substantially orthogonal to said axis of rotation, and a magnetic extension piece oriented substantially parallel to said axis of rotation, said face contact surface configured to contact the end surface of the magnetic object and said magnetic extension piece configured to contact no more than two side surfaces of the at least two side surfaces of the magnetic object, said magnetic extension piece further comprising a first magnetic extension piece half with a first side contact surface configured to contact one side surface of said two side surfaces of the at least two side surfaces of the magnetic object and a second magnetic extension piece half with a second side contact surface configured to contact the other side surface of said two side surfaces of the at least two side surfaces of the magnetic object, said first and second magnetic extension piece halves are in a spaced relationship and said first and second side contact surfaces are in a non-coplanar relationship, said face contact surface and said magnetic extension piece serving to concentrate and shape said magnetic field into the magnetic object, said head further configured to be spatially open opposite from both said face contact surface and said magnetic extension piece so as to receive and contact the magnetic object;

whereby, when the substantially prismatic shape of the magnetic object is placed in proximity to said face contact surface of said head, said magnetic field draws the magnetic object into contact with said face contact surface and said magnetic extension piece, the device thereby engaging the magnetic object and allowing for its manipulation.

2. The device of claim 1 wherein said head further comprises a magnet positioned on said face contact surface and adjacent to said first and said second magnetic extension piece halves;

whereby, said magnet establishes said magnetic field in said head.

3. The device of claim 2 wherein said magnet is an electromagnet.

4. The device of claim 1 further comprising: a flexible shaft, said flexible shaft having a first and a second end, said first end attached to and supporting said head; and a handle, said handle attached to and supporting said second end of said flexible shaft;

whereby, the magnetic object may be remotely manipulated with the device in areas of limited access.

5. The device of claim 4 further comprising a semi-rigid adjustable arm assembly associated with said flexible shaft;

whereby, said flexible shaft may be maintained in a flexed position by positioning said adjustable arm assembly so that the magnetic object may be remotely manipulated with the device in distant areas of limited access.

6. The device of claim 1 wherein said non-coplanar relationship between said first and said second side contact surfaces comprises an angle between said contact surfaces approximately equal to the absolute value of 180°-360° m/n, where $n \geqq 2m+1$, where n is a positive whole number representing the number of sides of the prismatic shape of the magnetic object, and where m is a positive whole number representing a displacement number of sides from a reference side on the prismatic shape of the magnetic object.

7. The device of claim 1 wherein said first and said second magnetic extension piece halves comprise opposing magnetic poles.

8. The device of claim 1 wherein said head further comprises a knurled surface positioned at least partially about said axis of rotation.

9. The device of claim 1 wherein said head further comprises a socket element for removably engaging a drive post from a driver assembly.

10. The device of claim 9 further comprising a driver assembly, said driver assembly comprising: a drive post; a flexible driver shaft, said flexible driver shaft having a first and second driver end, said first driver end attached to and supporting said drive post; and a driver handle, said driver handle attached to and supporting said second driver end of said flexible driver shaft;

whereby, said drive post may removably engage with said socket element and the magnetic object may be remotely manipulated with the device in areas of limited access.

11. The device of claim 10 further comprising a semi-rigid adjustable arm assembly associated with said flexible driver shaft;

whereby, said flexible driver shaft may be maintained in a flexed position by positioning said adjustable arm assembly so that the magnetic object may be remotely manipulated with the device in distant areas of limited access.

12. A method of manipulating a magnetic object, at least a portion of the magnetic object having a substantially prismatic shape with at least two side surfaces and an end surface, the method comprising the steps of:

(a) providing a manipulation device comprising; a head having a magnetic field and an axis of rotation, said head comprising a face contact surface oriented substantially orthogonal to said axis of rotation, and a magnetic extension piece oriented substantially parallel to said axis of rotation, said face contact surface configured to contact the end surface of the magnetic object and said magnetic extension piece configured to contact no more than two side surfaces of the at least two side surfaces of the magnetic object, said magnetic extension piece further comprising a first magnetic extension piece half with a first side contact surface configured to contact one side surface of said two side surfaces of the at least two side surfaces of the magnetic object and a second magnetic extension piece half with a second side contact surface configured to contact the other side surface of said two side surfaces of the at least two side surfaces of the magnetic object, said first and second magnetic extension piece halves are in a spaced relationship and said first and second side contact surfaces are in a non-coplanar relationship, said face contact surface and said magnetic extension piece serving to concentrate and shape said magnetic field into the magnetic object, said head further configured to be spatially open opposite from both said face contact surface and said magnetic extension piece so as to receive and contact the magnetic object;

(b) positioning the end surface of the magnetic object in contact with said face contact surface of said head of said manipulation device;

(c) positioning said no more than two side surfaces of the at least two side surfaces of the magnetic object in contact with said magnetic extension piece of said head of said manipulation device;

(d) retaining by magnetic attractive force, the magnetic object in position on said head of said manipulation device;

(e) manipulating said manipulation device and thereby manipulating the magnetic object; and (f) removing the magnetic object from said manipulation device.

13. The method of claim 12 wherein said step of providing a manipulation device comprises providing a device wherein said head further comprises a magnet positioned on said face contact surface and adjacent said first and second magnetic extension piece halves, whereby, said magnet establishes said magnetic field in said head.

14. The method of claim 12 wherein said step of providing a manipulation device comprises providing a device further comprising a flexible shaft, said flexible shaft having a first and a second end, said first end attached to and supporting said head; and a handle, said handle attached to and supporting said second end of said flexible shaft, and said step of manipulating the magnetic object comprises remotely manipulating the magnetic object.

15. The method of claim 14 wherein said step of providing a manipulation device comprises providing a device further comprising a semi-rigid adjustable arm assembly associated with said flexible shaft, and the method further comprises a step of positioning said adjustable arm assembly and thereby positioning said flexible shaft in a user defined configuration for remote manipulation of the magnetic object in distant areas of limited access.

16. The method of claim 12 wherein said step of providing a manipulation device comprises providing a device wherein said non-coplanar relationship between said first and second side contact surfaces comprises an angle between said contact surfaces approximately equal to the absolute value of 180°-360° m/n, where $n \geqq 2m+1$, where n is a positive whole number representing the number of sides of the prismatic shape of the magnetic object, and where m is a positive whole number representing a displacement number of sides from a reference side on the prismatic shape of the magnetic object.

17. The method of claim 12 wherein said step of providing a manipulation device comprises providing a device wherein said first and second magnetic extension piece halves comprise opposing magnetic poles.

18. The method of claim 12 wherein said step of providing a manipulation device comprises providing a device wherein said head further comprises a knurled surface positioned at least partially about said axis of rotation.

19. The method of claim 12 wherein said step of providing a manipulation device comprises providing a device wherein said head further comprises a socket element for removably engaging a drive post from a driver assembly.

20. The method of claim 19 wherein said step of providing a manipulation device comprises providing a device further comprising a driver assembly, said driver assembly comprising a drive post; a flexible driver shaft, said flexible driver shaft having a first and second end, said first end attached to and supporting said drive post; and a driver handle, said driver handle attached to and supporting said second end of said flexible driver shaft; and the method further comprises a step of engaging said drive post in said socket element before said step of positioning the magnetic object in contact with said head of the manipulation device.

21. The method of claim 20 wherein said step of providing a manipulation device comprises providing a device further comprising a semi-rigid adjustable arm assembly associated with said flexible driver shaft, and the method further comprises a step of positioning said adjustable arm assembly and thereby positioning said flexible driver shaft in a user defined configuration for remote manipulation of the magnetic object in distant areas of limited access.

* * * * *